US005664526A

United States Patent [19]

Logan et al.

[11] Patent Number: 5,664,526

[45] Date of Patent: Sep. 9, 1997

[54] APPARATUS FOR SEPARATING SOLID MATERIAL FROM COOLING WATER IN A MARINE ENGINE BLOCK

[75] Inventors: Andrew K. Logan, Stillwater, Okla.; Matthew W. Jaeger, Fond du Lac, Wis.; Terry D. Axton; William E. Hughes, both of Stillwater, Okla.; David J. Gruenwald, Butte des Monts, Wis.

[73] Assignee: Brunswick Corporation, Lake Forest, Ill.

[21] Appl. No.: 521,748

[22] Filed: Aug. 31, 1995

[51] Int. Cl.[6] ..... F01P 11/02

[52] U.S. Cl. ..... 123/41.14; 440/88; 440/900

[58] Field of Search ..... 123/41.14; 440/88, 440/900

[56] References Cited

U.S. PATENT DOCUMENTS

| | | | |
|---|---|---|---|
| 1,468,068 | 9/1923 | Hanson | 137/62 |
| 4,082,068 | 4/1978 | Hale | 123/41.02 |
| 4,693,690 | 9/1987 | Henderson | 440/88 |
| 4,758,190 | 7/1988 | Van Buren | 440/88 |

OTHER PUBLICATIONS

"Dole Freeze Protection Valve", Eaton Corporation.

*Primary Examiner*—Noah P. Kamen

*Attorney, Agent, or Firm*—Andrus, Sceales, Starke & Sawall

[57] ABSTRACT

An apparatus for separating solid material from cooling water in the cooling system of the engine block of a marine engine. The engine block comprises a plurality of cylinder bores surrounded by a cooling passage through which cooling water is pumped. The bottom portion of the block includes a drain outlet that communicates with the cooling passage and a tubular separating member has a first generally horizontal section that is sealed within the drain outlet. The tubular separator also includes a second section that is located within the cooling passage and extends downwardly from the inner end of the first section and is located between two adjacent cylinder bores. The lower end of the second section is closed and a port is provided in the side of the second section adjacent the closed end and facing toward one of the cylinder bores. The outer end of the first section of the tubular member, which is located on the exterior of the block, is connected through a suitable hose or conduit to an automatic drain valve which is located at a level beneath the engine block. When the ambient temperature falls beneath a selected value, the drain valve will open and water will drain from the engine block through the tubular separator to the drain valve, while solid debris will collect in the bottom of the cooling passage beneath the level of the port to prevent the debris from contacting the temperature responsive valve.

7 Claims, 1 Drawing Sheet

FIG. 1
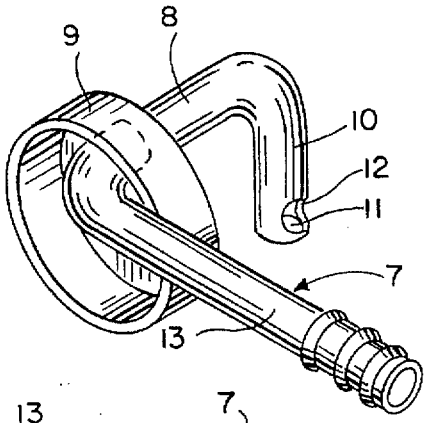
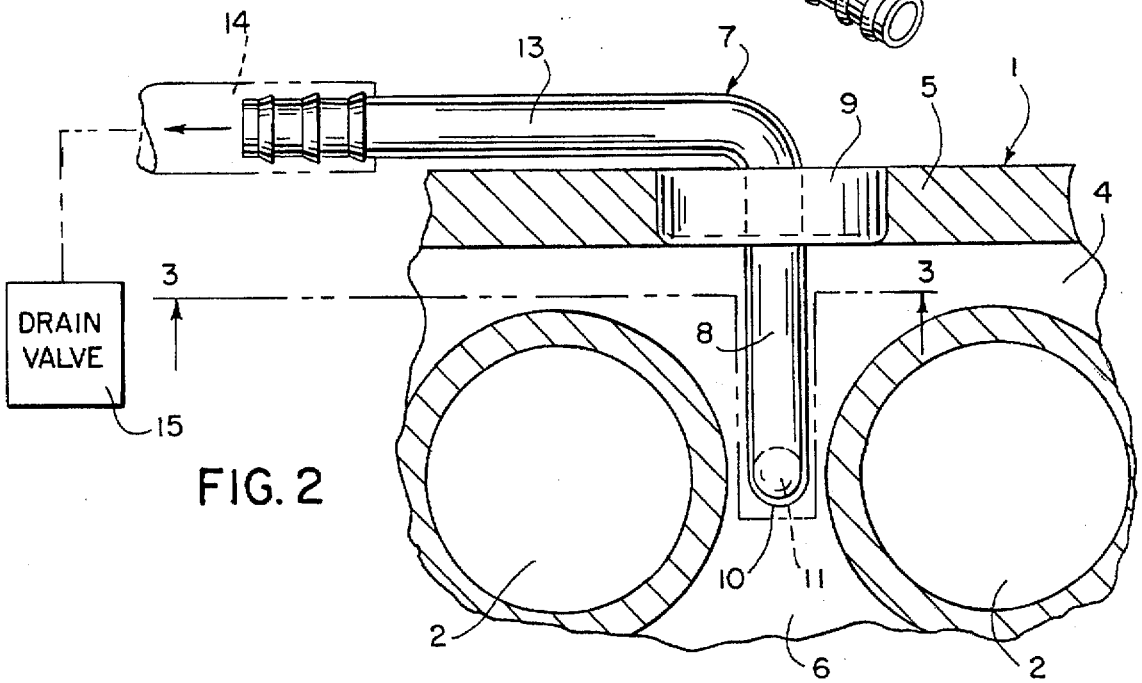
FIG. 2
FIG. 3
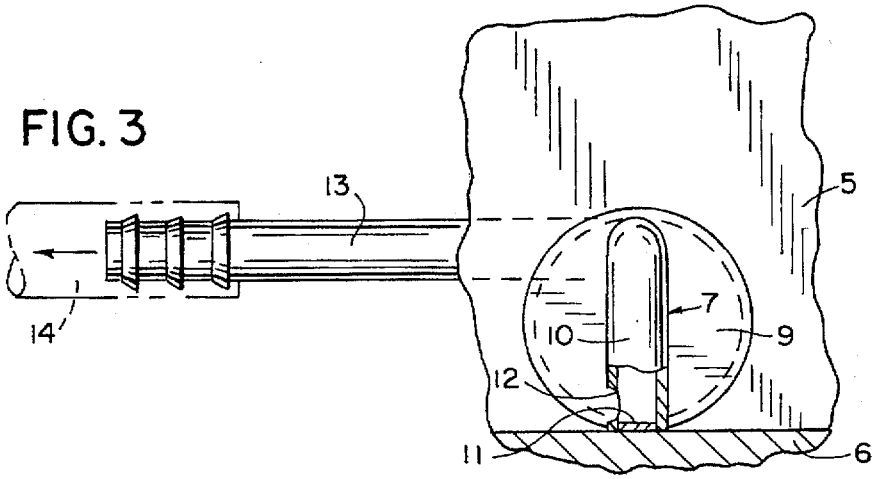

APPARATUS FOR SEPARATING SOLID MATERIAL FROM COOLING WATER IN A MARINE ENGINE BLOCK

BACKGROUND OF THE INVENTION

A conventional inboard marine engine utilizes a cooling system in which seawater is drawn from the lake or other body of water and is circulated through the cooling system, and then discharged overboard. In a typical cooling system for V-6 inboard marine engine, seawater is drawn into the cooling system by a pickup pump, and is then directed to a thermostat housing, which contains a thermostat. When the thermostat is closed, a portion of the incoming water will be pumped by a circulating pump through outlets in the thermostat housing to exhaust elbows of the engine, while a second portion of the incoming seawater is circulated through the engine block. As the temperature rises and the thermostat is opened, a portion of the returning water in the circulating system will flow to the exhaust manifolds, and then overboard in the exhaust of the engine.

When the engine is not operating, water will collect in certain portions of the cooling system, such as the exhaust manifold, the engine block and the circulating pump. If the ambient temperature drops below freezing for extended periods, the collected water can freeze, which can cause cracking of the engine block or other components of the engine. Because of this, it is customary to winterize the engine at the outset of cold weather. However, winterizing is a difficult and time consuming operation, but because of the potential danger of freezing, the marine engine is normally winterized well before the advent of freezing weather, thus substantially reducing the overall boating season.

The co-pending U.S. patent application Ser. No. 08/521,746 filed Aug. 31, 1995 and entitled Drain Valve for a Marine Engine, is directed to a drain valve assembly associated with an inboard marine engine for automatically draining water from the cooling system when the ambient temperature decreases below a preselected value, such as about 50° F. The drain valve of the above mentioned patent application is connected via hoses or conduits to the exhaust manifolds of the engine, the exhaust elbows, and the engine block. When the ambient temperature falls below the preselected value, the drain valve will open, thus draining water from these portions of the engine to prevent freezing of the water and potential damage to the engine.

The seawater which is circulated through the cooling system of the marine engine contains debris, such as sand, dirt, and other particulate material. In order for the drain valve to function automatically and effectively, it is necessary to keep the debris away from the drain valve. Debris lodging between the valve members and the valve seats can cause leakage through the valve.

SUMMARY OF THE INVENTION

The invention is directed to an apparatus for separating solid material from cooling water in the cooling system of an engine block of a marine engine and has particular application for separating solid material or debris from cooling water that is discharged to an automatic temperature responsive drain valve.

The marine engine block is of conventional construction and includes a plurality of cylinder bores, and a cooling passage in the block surrounds the cylinder bores. With a typical V-type engine the block includes both a port and starboard cooling passage, and incoming seawater is circulated from the thermostat housing through both of the cooling passages by a circulating pump, and is returned to the thermostat housing.

In accordance with the invention, the engine block includes a drain outlet that communicates with the lower end of each cooling passage. The drain outlet can be an opening in the engine block that normally receives a freeze plug. A generally horizontal first section of a tubular separating member is sealed within the drain opening. The tubular separating member also includes a generally vertical section which extends downwardly from the inner end of the first section and is located within the cooling passage between a pair of adjacent cylinder bores. The lower end of the second vertical section is closed and an outlet port is formed in the side of the second section beneath the closed end and faces in a direction toward one of the cylinder bores.

The tubular separator member also includes a third or outer section which is connected to the outer end of the first horizontal section, and a hose or conduit connects the third section to an automatic temperature responsive drain valve which is mounted on the engine at a level beneath the drain outlet in the block. The temperature responsive drain valve is characterized by the ability to open when the ambient temperature falls below a preselected value, such as about 50° F. When the ambient temperature is above 50° F., the drain valve will remain in the closed position, so that there will be no flow through the tubular separating member to the drain valve. However, if the engine is not operating and the ambient temperature falls below 50° F., the drain valve will open and cooling water will then flow from the cooling passage in the engine block through the separator member and through the open drain valve for discharge overboard.

Under normal operating conditions of the engine, cooling water will be pumped into the cooling passage in the block, and due to the configuration of the cooling passage and the presence of the cylinder bores, the cooling water will move in a swirling pattern. As the inlet port to the tubular separating member is located between a pair of adjacent cylinder bores, it is sheltered and will not be exposed to direct flow of the cooling water within the cooling passage.

During normal operation, any debris in the water, such as sand, dirt, or solid particles, will be carried with the water flow and will not be deposited in the cooling passage.

If the engine is not operating and the ambient temperature falls below the selected temperature of about 50° F., the drain valve will automatically open, thus draining cooling water from the cooling passage in the engine block. Any solid debris in the cooling water will collect in the bottom of the cooling passage beneath the level of the port in the tubular separating member, so that the debris will not be drawn to the drain valve. Thus, the construction of the invention enables water contained within the cooling passage of the engine block to be automatically drained through the drain valve, so that substantially all water will be removed from the cooling passages in the block, thus eliminating any potential water freezing problems, and yet the solid debris will be retained within the cooling passage of the block, so that it will not interfere with operation of the automatic drain valve.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the tubular separating member of the invention;

FIG. 2 is a horizontal section showing the separator member as connected to the engine block of a marine engine; and FIG. 3 is a view taken along line 3—3 of FIG. 2.

DESCRIPTION OF THE ILLUSTRATED EMBODIMENT

The drawings illustrate a separator for separating solid debris or material from cooling water that is being drained from the engine block of an inboard marine through a temperature responsive drain valve. The separator has particular application for use with an automotive drain valve of the type described in copending U.S. patent application Ser. No. 08/521,746, filed Aug. 31, 1995, and entitled Drain Valve For A Marine Engine, and the construction as shown in that patent application is incorporated herein by reference.

The drain valve as described in the aforementioned patent application is mounted on the lower portion of the marine engine and is connected via a plurality of hoses or conduits to various portions of the cooling system of the engine. The valve operates in a manner such that when the ambient temperature falls below a preselected value, such as perhaps 50° F., the drain valve will open to permit the cooling water in the various portions of the engine to drain by gravity.

The separator as illustrated in the drawings is adapted to be connected to the engine block of the marine engine and acts to prevent solid debris, such as sand, dirt, small particles of leaves or seaweed, or other particulate material from flowing from the cooling passage of the engine block to the drain valve, when the drain valve is open.

The separator of the invention can be incorporated with the engine block of an inboard marine engine, such as, for example, a V-6 engine. The engine block 1, includes a plurality of cylinder bores 2, only two of which are shown in the drawings.

Block 1 includes a cooling passage 4 which surrounds the cylinder bores 2, and cooling water is pumped through the cooling passage 4. With a V-6 engine, the block will include both a port and starboard cooling passage 4, with each passage surrounding a bank of cylinder bores.

In a typical marine engine, the cooling water is pumped by a circulating pump from the thermostat housing to the cooling passages 4 in the engine block and is then returned to the thermostat housing.

As shown in FIGS. 2 and 3, block 1 includes a side wall 5 which borders a side of cooling passage 4, and a bottom wall 6, which borders the bottom of the cooling passage.

In accordance with the invention, a tubular separator 7 is mounted in the lower portion of the block 1, and serves to connect the cooling passage 4 with an automatic temperature responsive drain valve which is mounted on the engine at a lower level. Separator 7 includes a first generally horizontal section 8 which is mounted in sealed relation within an opening in the lower portion of block 1. In practice, the opening may be closed off by a conventional freeze plug 9 and inner section 8 is sealed within a hole in the upper portion of the freeze plug. The inner end of horizontal section 8 extends within cooling passage 4, and the separator also includes a second generally vertical section 10 that is connected to the inner end of section 8 and extends downwardly between a pair of cylinder bores 2, as seen in FIG. 2. The lower end of the vertical section 10 is closed off, as indicated by 11, and an inlet port 12 is formed in the side of section 10 immediately above the closed end 11. Port 12 faces in a direction toward one of the cylinder bores 2. The water being pumped through the cooling passage 4 has a swirling pattern and has no distinct flow path. By locating the inlet port 12 between a pair of cylinder bores 2 and facing the port toward one of the bores, the inlet port is sheltered and is not exposed to direct flow of the cooling water within the passage 4.

Separator 7 also includes a third outer section 13 that extends generally horizontally from the outer end of the first section 8 and a hose or conduit 14 connects the outer section 13 with an automatic temperature responsive drain valve 15. The drain valve 15 can be constructed in the manner set forth in the copending U.S. patent application Ser. No. 08/521,746, filed Aug. 31, 1995.

Under normal operating conditions of the marine engine, cooling water will be pumped through the cooling passage 4 by the circulating pump. During these normal operating conditions, the drain valve 15 will be closed, so that there will be no flow of cooling water through the separator 7 or hose 14, which is connected to the drain valve. When operation of the engine is terminated, the cooling water will remain in the cooling passage 4 of the block, as well as in the separator and hose 14 leading to drain valve 15.

If the ambient temperature falls below the preselected temperature, such as about 50° F., while the engine is not operating, drain valve 15 will open, thus permitting the cooling water in hose 14 and separator 7, as well as in the cooling passage 4 of the block, to drain through the open drain valve 15 and the cooling water is then discharged overboard. Solid debris which may be in the cooling water will settle to the bottom of the cooling passage beneath the inlet port 12 and will not be drawn through the separator 7 to the drain valve. While the solid debris will be retained within the cooling passage, substantially all of the water in the cooling passage 4 will be drained through the open drain valve 15, thus preventing any potential problem of the water freezing in the cooling passage and cracking the block. Any cooling water remaining in the cooling passage 4 beneath the level of port 12 will not cause a problem if it freezes.

If the engine is restarted while the drain valve 15 is open, a portion of the cooling water entering the cooling passage 4 will flow through the separator 7 and the open drain valve, while the major portion of the cooling water will flow through the cooling passage 4 and be returned to the thermostat housing. As the engine temperature increases, the engine heat will heat the temperature responsive element in the drain valve above the preselected temperature, thus automatically closing the drain valve and discontinuing the flow of cooling water through separator 7 and hose 14 to the drain valve.

We claim:

1. An apparatus for separating solid material from cooling water in the cooling system of an engine block of a marine engine, comprising a marine engine block having a plurality of cylinder bores and having a cooling passage surrounding said bores, said cooling passage containing cooling water, said block having a drain outlet communicating with a lower portion of said cooling passage, a tubular separator member including a first generally horizontal section disposed in said drain outlet, said first section having an inner end disposed in said cooling passage and having an outer end disposed on the exterior of said block, said tubular member also including a second section extending downwardly from the inner end of said first section and located between two adjacent cylinder bores, said second section having a closed lower end, port means disposed in the side of said second section above said closed lower end and providing communication between said cooling passage and the interior of said separator, and conduit means connecting the outer end of said first section with a temperature responsive drain valve.

2. The apparatus of claim 1, wherein said port means is located immediately above said closed lower end.

3. The apparatus of claim 1, wherein said separator also includes a third section connected to the outer end of said first section, said third section being generally horizontal and disposed at an angle of about 90° with respect to said first section.

4. The apparatus of claim 1, wherein said port means faces one of said cylinder bores.

5. An apparatus for separating solid material from cooling water in the cooling system of an engine block of a marine engine, comprising a marine engine block having a plurality of cylinder bores and having a cooling passage surrounding said bores, said cooling passage containing circulating cooling water, said block having a side wall bordering a side of said cooling passage and having a bottom wall bordering a bottom of said cooling passage, drain outlet means in the side wall of said block above said bottom wall and communicating with said cooling passage, a tubular separator having a first generally horizontal section disposed in sealed relation within said drain outlet means, said first section having an inner end disposed in said cooling passage and having an outer end disposed on the exterior of said block, said separator also including a second section extending generally vertically from the inner end of said first section and located between two adjacent cylinder bores, said second section having a closed lower end, port means disposed in a side of said second section above said closed end and facing one of said cylinder bores, said separator also including a third section connected to the outer end of said first section, a temperature responsive drain valve mounted on the engine at a level beneath said drain outlet means, said valve being characterized by the ability to open when the ambient temperature falls beneath a preselected value, and conduit means connecting the third section of said separator to said valve, a decrease in the ambient temperature beneath said preselected value when the engine is not operating causing said valve to open to drain cooling water from said cooling passage while any solid debris contained in the cooling water will be retained within the lower end of said cooling passage beneath the level of said port means.

6. In combination, a marine engine block having a plurality of cylinder bores and having a cooling passage surrounding said bores, said cooling passage containing cooling water, said block having a drain outlet communicating with said cooling passage, separator means disposed in said cooling passage for separating solid material from the cooling water, said separator means including tubular means extending through an opening in a side wall of said block and having an inner end portion disposed in said cooling passage between a pair of adjacent cylinder bores and having an outer end portion located on the exterior of said block, said inner end portion having a port, said port being located slightly above the bottom of said cooling passage, a temperature responsive drain valve mounted on the engine at a level beneath said drain outlet, said valve being characterized by the ability to open when the ambient temperature falls beneath a preselected value, and conduit means connecting the outer end portion of said tubular means to said valve.

7. The combination of claim 6, wherein said port faces one of said cylinder bores.

* * * * *